US006035674A

United States Patent [19]

Nickel

[11] Patent Number: 6,035,674

[45] Date of Patent: Mar. 14, 2000

[54] DOOR LOCKING DEVICE WITH SEVERAL CLOSING RODS

[75] Inventor: Edgar Nickel, Angelburg, Germany

[73] Assignee: Rittal-Werk Rudolf Loh GmbH, Herborn, Germany

[21] Appl. No.: 08/930,887

[22] PCT Filed: Mar. 1, 1996

[86] PCT No.: PCT/EP96/00874

§ 371 Date: Mar. 3, 1998

§ 102(e) Date: Mar. 3, 1998

[87] PCT Pub. No.: WO96/27725

PCT Pub. Date: Sep. 12, 1996

[30] Foreign Application Priority Data

Mar. 7, 1995 [DE] Germany ..... 195 07 852

[51] Int. Cl.[7] ..... E05C 9/12

[52] U.S. Cl. ..... 70/103; 70/120; 292/39; 292/142

[58] Field of Search ..... 292/39, 142, 160, 292/34, 37; 70/103, 118–120, 190, 191

[56] References Cited

U.S. PATENT DOCUMENTS

| | | | |
|---|---|---|---|
| 533,298 | 1/1895 | Hollar | 292/39 |
| 1,035,531 | 8/1912 | Cobb | 292/39 |
| 1,179,731 | 4/1916 | McDonald | 292/39 |
| 1,464,458 | 8/1923 | Whartenby | 292/39 |
| 1,600,982 | 9/1926 | Golloway et al. | 292/39 X |
| 2,101,035 | 12/1937 | Mistretta | 292/39 X |
| 2,584,088 | 1/1952 | Floyd | 292/39 X |
| 3,329,106 | 7/1967 | Lingal | 292/39 X |
| 4,432,573 | 2/1984 | Goldman | 292/39 X |
| 5,094,483 | 3/1992 | James | 292/39 |
| 5,120,087 | 6/1992 | Pastva | 292/39 X |

FOREIGN PATENT DOCUMENTS

| | | | |
|---|---|---|---|
| 0 287 466 | 10/1988 | European Pat. Off. . | |
| 341529 | 11/1989 | European Pat. Off. | 292/39 |
| 796545 | 4/1936 | France | 292/39 |
| 933509 | 11/1951 | France . | |
| 1013125 | 7/1952 | France | 292/39 |
| 1269754 | 7/1961 | France | 292/39 |
| 2396855 | 2/1979 | France . | |
| 2592085 | 6/1987 | France . | |
| 328427 | 10/1920 | Germany . | |
| 401519 | 9/1924 | Germany | 292/39 |
| 610823 | 3/1935 | Germany | 292/39 |
| 3801 039 A1 | 8/1988 | Germany . | |
| 37 10 563 A1 | 10/1988 | Germany . | |
| 8900484 | 4/1989 | Germany . | |
| 287573 | 7/1931 | Italy | 292/39 |
| 411723 | 6/1945 | Italy | 292/39 |
| 457275 | 5/1950 | Italy | 292/39 |
| 596879 | 8/1959 | Italy | 292/39 |
| 1774980 | 11/1992 | Russian Federation | 292/39 |
| 11310 | 5/1904 | United Kingdom | 292/39 |

*Primary Examiner*—Lloyd A. Gall
*Attorney, Agent, or Firm*—Jansson, Shupe, Bridge & Munger, Ltd.

[57] ABSTRACT

A door locking device has several closing rods that cooperate with closing recesses or closing elements on the body of a cabinet and that may be moved by a lock from open positions into closed positions and vice-versa. The number of closing points can be increased by simple, commercially available locks and bolts, as pairs of closing rods form the push rods of at least two push rod locking devices and in that the push rod locks carry additional pinions that are mutually coupled by a coupling rod with teeth and can be moved in the same direction.

11 Claims, 3 Drawing Sheets

DOOR LOCKING DEVICE WITH SEVERAL CLOSING RODS

RELATED APPLICATIONS

This application claims priority from German Patent Application No. 195 07 852.7 filed in the Federal Republic of Germany on Mar. 7, 1995.

1. Field of the Invention

This invention is related generally to door locks and, more particularly, to door locks with multiple locking rods that act in conjunction with lock receptacles or lock elements on a cabinet body, and can be brought into a locking position from an open position, and the reverse by means of a lock.

2. Background of the Invention

A door lock of this type is known from EP 0 373 068 A1, whereby locking areas are created on all sides of the door, except for the locking side. This known door locking device, however, requires a complicated lock that must be specifically adapted to the number of locking rods.

A door lock for an entrance door is known from FR A 2 592 085. With this known door lock multiple horizontal locking rods are respectively formed as paired push rods that move in opposite directions by means of respective drive sprockets. Additional sprockets are arranged on the push rods, moving in the same direction by means of an endless chain or toothed rack, so that the push rods of all locking rods move in common. The locking takes place with a separate lock.

As DE 23 01 371 C3 shows, a door lock is also known that has multiple turnbuckles as locking elements that are coupled with a common lock by means of linkages. In this case a distinction is made between primary and secondary turnbuckles. The primary turnbuckles are connected to a crank of the common lock by means of rods and control the secondary turnbuckles by means of control levers. This known door lock requires rods that are adapted to the dimension of the door and control levers, as well as specially designed turnbuckles with one or more guide pieces.

From DE 89 00 484 U1 a door lock is known whereby the door bears two oppositely moving locking strips with locking bolts, working in conjunction with lock receptacles in the frame of the door. The two locking strips each have a toothed rack. The toothed racks engage with a drive sprocket and move opposite each other. This known door lock is also adapted to the size of the door and uses specially manufactured lock parts.

OBJECTS OF THE INVENTION

It is an object of this invention to provide a door lock overcoming some of the problems and shortcomings of devices of the prior art.

Another object of this invention is to provide a door lock which can be constructed using commercial locks and locking devices.

Another object of this invention is to provide a door lock which can be constructed by means that allow one to easily increase the number of locking areas. How these and other objects are accomplished will be apparent from the following descriptions and from the drawings.

SUMMARY OF THE INVENTION

The invention involves an improvement to a door lock for a cabinet having a door with multiple locking rods that act in conjunction with lock elements on a cabinet body wherein the locking rods are mounted for movement between an unlocked position and a locked position.

The improvement is characterized by the fact that the locking rods comprise first and second pairs of push rods. First and second drive sprockets engage, respectively, the rods comprising the first pair of rods and the rods comprising the second pair of rods. The first drive sprocket moves, in opposite directions, the rods comprising the first pair of rods and the second drive sprocket moves, in opposite directions, the rods comprising the second pair of rods. The improved lock also includes first and second additional sprockets which are coupled, respectively, to the first and second drive sprockets. Also, the first and second additional sprockets engage a coupling rod that causes rotation of the second drive sprocket and the second additional sprocket when the first drive sprocket is rotated.

In one embodiment of the invention, the door has interior and exterior surfaces and the pairs of rods are aligned in parallel and mounted adjacent to the interior surface of the door. In a specific version of the embodiment, the first drive sprocket is rotated by a key while in a more specific version, both the first and second drive sprockets are rotated by a key.

In such embodiment, the first drive sprocket and the first additional sprocket are coupled together by a common shaft. In another version of the embodiment, the second drive sprocket and the second additional sprocket are coupled together by a common shaft.

In another embodiment, when the push rods are in the locked position, the coupling rod engages the cabinet thereby functioning as an additional push rod. In still another embodiment, the coupling rod is connected to an additional locking rod.

In yet another embodiment of the invention, each of the push rods has a first end and a second end, a plurality of guides are fixed to the door and when the first drive sprocket is rotated, the first and second ends of the push rods move in a respective one of the plurality of guides.

In another embodiment, the door lock includes locking elements each having a stop setting. The push rods have first and second ends and the ends of the push rods are provided with rotatably supported rollers that act in conjunction with the locking elements.

In yet another embodiment of the invention, the door has opposed first and second edges along with a third and fourth edge that are opposite one another and perpendicular to the first and second edges. In such embodiment, the first and second pairs of push rods are attached to the door adjacent to the first and second edges, respectively while a coupling rod located about midway between the third and fourth edges couples the pairs of push rods together.

In still another embodiment, the door has a locking edge and a hinge edge and the first pair of push rods is attached adjacent to the locking edge of the door. In this embodiment, the second pair of push rods is positioned between the first pair of push rods and the hinge edge of the door.

DETAILED DESCRIPTION OF THE PREFERRED EMBODIMENTS

Figure 1:
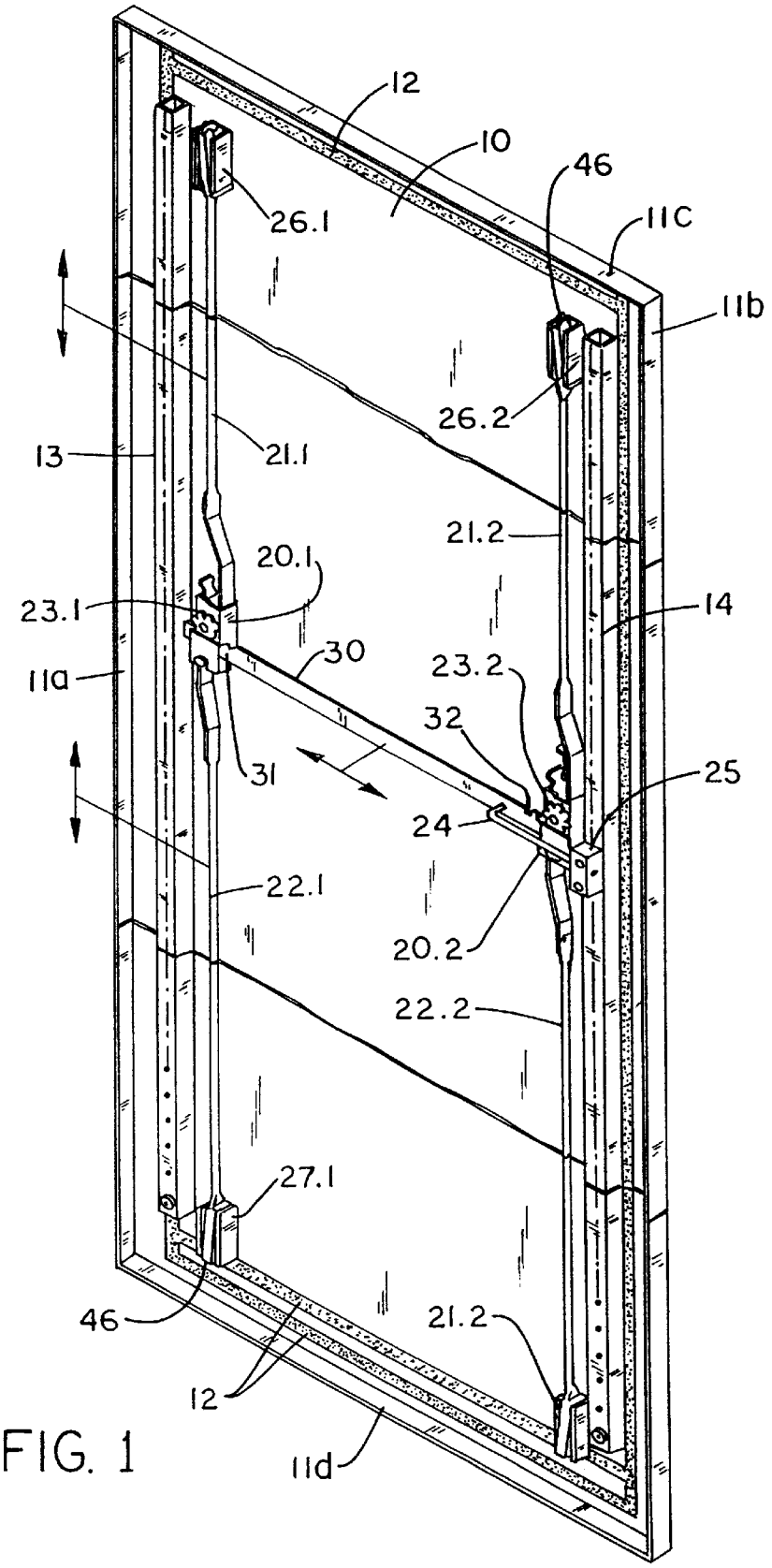
FIG. 1 is a perspective view of the interior surface of a door embodying the improved door lock system of the invention.

Referring to FIG. 1, the door 10 has an interior surface, opposed first and second edges 11*a* and 11*b*, respectively, and opposed third and fourth edges 11*c* and 11*d*, respectively. The edges 11*c*, 11*d* are parallel to one another and perpendicular to the first and second edges 11*a* and 11*b*. The edges 11*a–d* are beveled and define the circumference of the door 10. Those edges 11*a*, 11*b* which are vertical in FIG. 1 bear mounting rails 13 and 14 connected to such edges 11*a* and 11*b*. Such mounting rails 13 and 14, provide additional reinforcement for the door 10. When the door 10 is in the closed position, a gasket frame 12 that is foamsprayed onto the interior surface of the door 10 serves as the seal cooperating with a similarly-shaped "frame" of gasket pieces adhering to the body of a cabinet to which the door 10 is mounted.

Two push rod locking devices are connected to the mounting rails 13 and 14, respectively. Such locking devices comprise two push rod locks 20.1 and 20.2. The lock 20.1 includes two push rods 21.1 and 22.1 while the lock 20.2 includes two push rods 21.2 and 22.2. In one embodiment of the invention, the ends of the push rods 21.1 and 22.1 or 21.2 and 22.2 are movably guided in guides 26.1, 27.1, 26.2, 27.2 that are fixed to the door 10. A drive sprocket 23.0 is rotatably supported in each of the push rod locks 20.1, 20.2. The push rods of a particular lock, i.e., push rods 21.1 and 22.1 of lock 20.1 and push rods 21.2 and 22.2 of lock 20.2 engage their respective drive sprocket 23.0 diametrically. When the drive sprocket 23.0 is rotated, the push rods 21.1 and 22.1 or 21.2 and 22.2 are moved in opposite directions and thereby assume either the open or the closed position.

Figure 2:
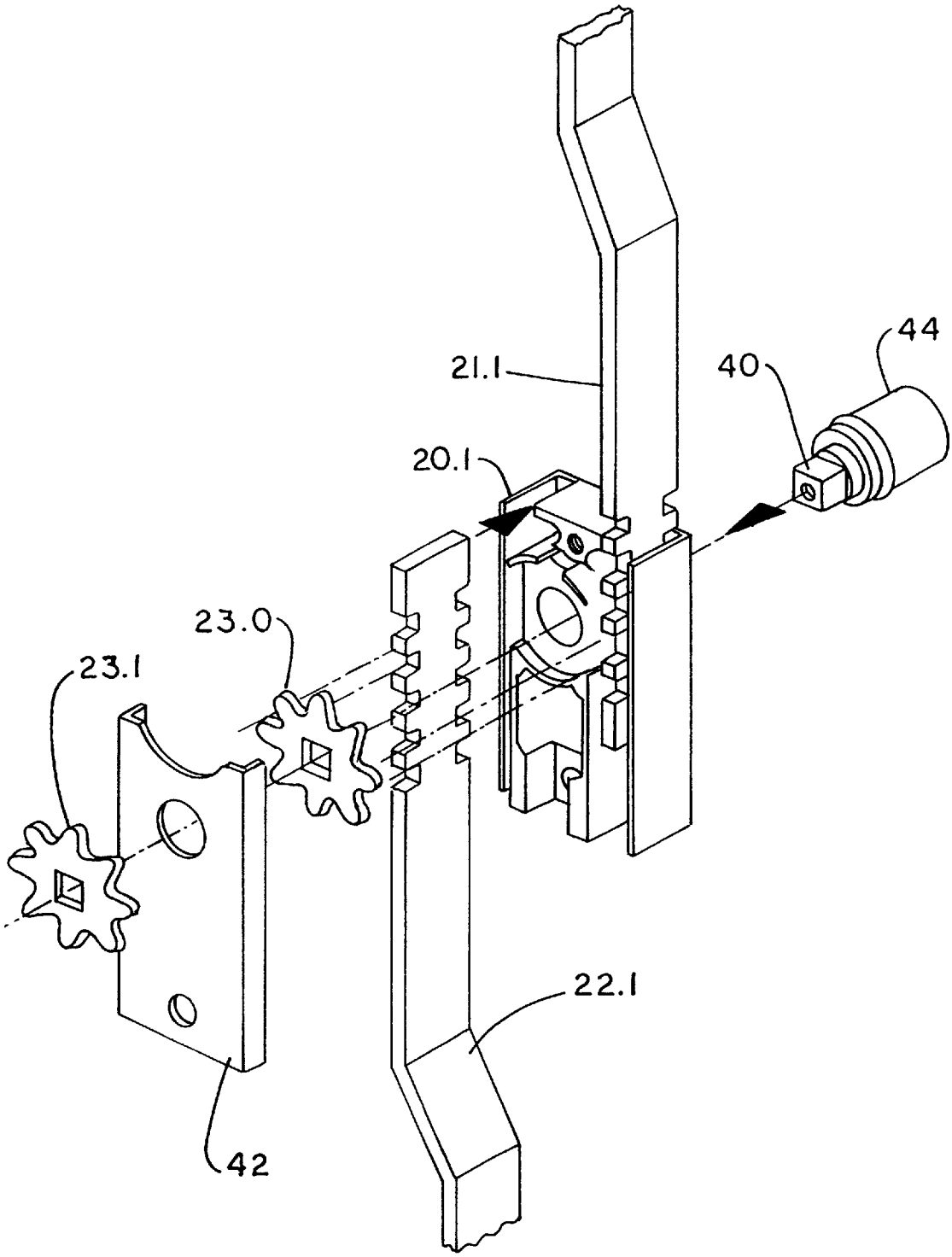
FIG. 2 is an exploded perspective view of the push rod lock components of the new door lock system.

The push rod locks 20.1 and 20.2 are preferably substantially identical in construction. Therefore, only lock 20.1 will be described. As shown in FIG. 2, the shaft 40 extends through the drive sprocket 23.0, projects through the lock plate 42 and rotatably engages an additional sprocket 23.1. The lock plate 42 encloses the sprocket 23 within a lock housing 20.1, and additional sprocket 23.1 is located outside of lock housing 20.1. A coupling rod 30 that bears teeth 31 and 32 on both ends engages with the additional sprocket 23.1 and with the corresponding additional sprocket of lock 20.2. The above description and FIGS. 1 and 2 make it clear that coupling rod 30 couples two push rod locks 20.1, 20.2 together. After appreciating the foregoing, one of ordinary skill will understand that the coupling rod 30 is capable of coupling three or more push rod locks together. Such coupling, used with three or more locking devices and their respective additional sprockets, configure the system so that when a particular shaft, drive sprocket and additional sprocket are rotated by inserting a key into the key receptacle 44, all of the corresponding push rods, e.g., rods 21.1, 21.2 or rods 22.1, 22.2 move in the same direction.

In one particular embodiment, only one of the two push rod locks 20.1 and 20.2 is fitted with a key receptacle 44 to be actuated by means of a key. In another embodiment, each of the push rod locks 20.1 and 20.2 has a key receptacle 44 and such receptacles 44 may be keyed identically or configured to receive different keys. But in each highly preferred embodiment, all push rod locks, e.g., locks 20.1 and 20.2, are actuated simultaneously when any one of the push rod locks 20.1 or 20.2 is actuated.

The coupling rod 30 or push rod 24 connected to the coupling rod 30 can be used to provide an additional locking point. When coupling rod 30 is used to provide such additional locking point, the length of the rod 30 is extended as needed to engage the cabinet. The push rod 24 is movably guided in a guide 25 and when the rod 30 moves rightwardly (as viewed in FIG. 1), the rod 24 extends laterally outwardly from the guide 25 to engage an opening or other engagement device in the cabinet to which the door 10 is mounted.

Figure 3:
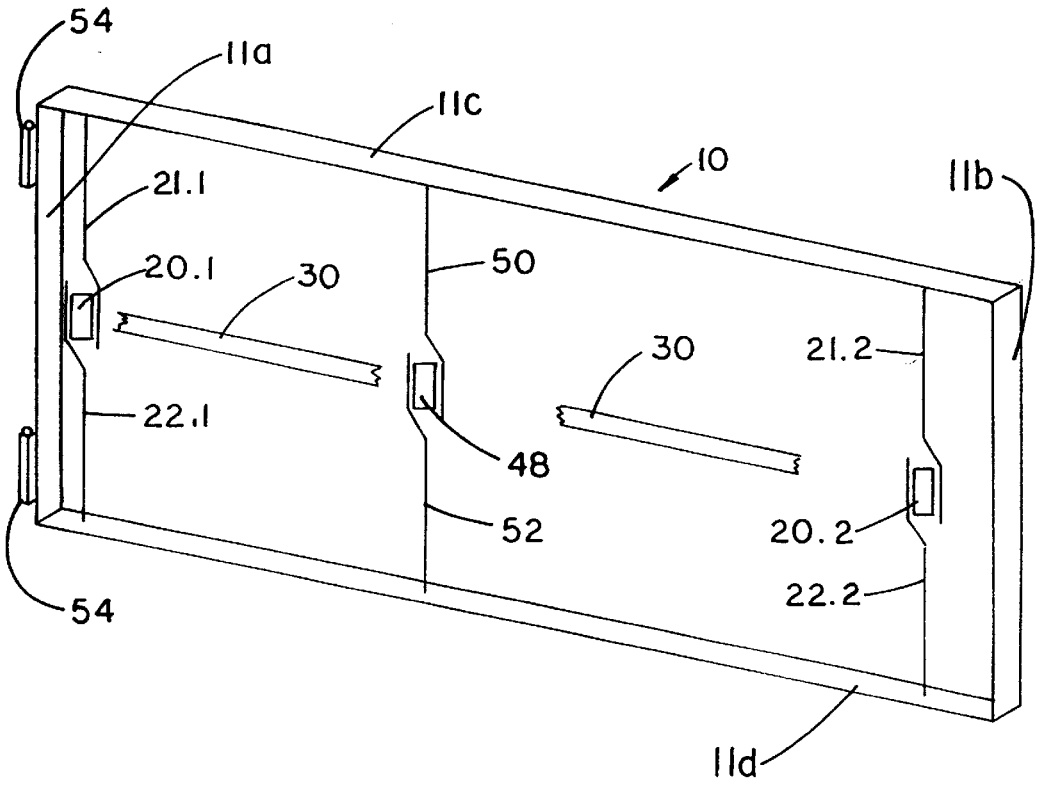
FIG. 3 is a representative perspective view of the interior surface of another embodiment of a door incorporating the improved door lock system.

In the embodiment of FIG. 1, the door 10 is configured to be attached to cover the opening in a cabinet body without the use of hinges. That is, the door 10 can be lifted off of and away from a cabinet when the locks 20.1, 20.2 are in the open or "door unlocked" position. And when the door 10 is placed over the opening of a cabinet and the locks 20.1, 20.2 manipulated to the closed or "door locked" position, the rods 21.1, 22.1, 21.2, 22.2 lock into respective engagement points on the cabinet and provide four points of attachment, one at each of the four corners of the door 10. And, if used, the coupling rod 30 and/or push rod 24 provides an additional point of attachment and locking which is about in the center (considered vertically in FIG. 1) of the door 10. Referring to FIG. 3, if the width of the door 10 is relatively great compared to its height, another push rod lock 48 and its push rods 50, 52 can be arranged laterally about midway between the two push rod locks 20.1, 20.2.

On the other hand, the door 10 (as, for example, the door 10 of FIG. 3) may have one or more hinges 54 along one edge, e.g., edge 11*a*, and be attached thereby to the cabinet body. In such configuration, one push rod locking device (comprising lock 20.2 and rods 21.2, 22.2) is arranged along what is termed the locking side at edge 11*b*. Another push rod locking device (comprising lock 48 and rods 50, 52 is attached between that locking device comprising lock 20.2 and rods 21.2, 22.2 and the hinged edge 11*a* of the door 10.

In yet another embodiment, the ends of the push rods 21.1, 22.1, 21.2, and 22.2 are fitted with rotatably-supported rollers 46 that act in conjunction with locking elements that feature a type of stop setting for the rollers 46. The design of the locking elements can additionally be designed such that the door 10 is pulled toward the cabinet body when in the locked end position, such as, for example, is known from German patent document DE 37 10 563 C2.

While the principles of this invention have been described in connection with specific embodiments, it should be understood clearly that these descriptions are made only by way of example and are not intended to limit the scope of the invention.

I claim:

1. In a door lock for a cabinet having a door with multiple locking rods that act in conjunction with lock elements on a cabinet body, and wherein the locking rods are mounted for movement between an unlocked position and a locked position, the improvement wherein:

the locking rods comprise first and second pairs of push rods each having a first end and a second end;

first and second drive sprockets located, respectively, in first and second push rod lock housings where each housing is enclosed by a lock plate, wherein the sprockets engage, respectively, the rods comprising the first pair of rods and the rods comprising the second pair of rods;

the first drive sprocket moves, in opposite directions, the rods comprising the first pair of rods and the second drive sprocket moves, in opposite directions, the rods comprising the second pair of rods;

the lock includes first and second additional sprockets located outside of the housing adjacent an end of the push rods, wherein the additional sprockets are coupled in a horizontal linear relation, to the first and second drive sprockets respectively; and the first and second additional sprockets engage a coupling rod located between the first and second pair of push rods, thereby causing rotation of the second drive sprocket and the second additional sprocket when the first drive sprocket is rotated.

2. The door lock according to claim 1 wherein:

the door has interior and exterior surfaces; and the pairs of rods are aligned in parallel and mounted adjacent to the interior surface of the door.

3. The door lock according to claim 1 wherein the first drive sprocket is rotated by a key.

4. The door lock according to claim 1 wherein the first and second drive sprockets are rotated by a key.

5. The door lock according to claim 1 wherein the first drive sprocket and the first additional drive sprocket are coupled together by a common shaft.

6. The door lock according to claim 1 wherein the second drive sprocket and the second additional sprocket are coupled together by a common shaft.

7. The door lock according to claim 1, wherein when the push rods are in the locked position, the coupling rod is engageable with the cabinet, thereby functioning as an additional push rod.

8. The door lock according to claim 1 wherein the coupling rod is connected to an additional locking rod.

9. The door lock according to claim 1 wherein:

a plurality of guides are fixed to the door; and when the first drive sprocket is rotated, the first and second ends of the push rods move in a respective one of the plurality of guides.

10. The door lock according to claim 1 wherein:

the door has opposed first and second edges;

a third and fourth edge opposite one another and perpendicular to the first and second edges;

the first and second pairs of push rods are attached to the door adjacent to the first and second edges, respectively; and the coupling rod couples the pairs of push rods together and is located about midway between the third and fourth edges.

11. The door lock according to claim 1 wherein:

the door has a locking edge and a hinge edge;

the first pair of push rods is attached adjacent to the locking edge of the door; and the second pair of push rods is between the first pair of push rods and the hinge edge of the door.

* * * * *

UNITED STATES PATENT AND TRADEMARK OFFICE

CERTIFICATE OF CORRECTION

PATENT NO. : 6,035,674

DATED : March 14, 2000

INVENTOR(S) : Edgar Nickel

It is certified that error appears in the above-identified patent and that said Letters Patent are hereby corrected as shown below:

In column 4, line 28, before "is" and after "52", insert --)--.
In column 4, line 64, delete "housing" and insert --housings--.
In column 5, line 15, after "additional", delete "drive".

Signed and Sealed this

Third Day of April, 2001

*Attest:*

Nicholas P. Godici

NICHOLAS P. GODICI

*Attesting Officer*

*Acting Director of the United States Patent and Trademark Office*